US009157213B2

(12) United States Patent
Beaudoin

(10) Patent No.: US 9,157,213 B2
(45) Date of Patent: Oct. 13, 2015

(54) ECCENTRIC FRAME FOR AN INLET OF A CATCH BASIN OR MANHOLE

(71) Applicant: CANADA PIPE COMPANY ULC, Hamilton (CA)

(72) Inventor: Pierre-Laurent Beaudoin, Lévis (CA)

(73) Assignee: CANADA PIPE COMPANY ULC, Hamilton, ON (CA)

( * ) Notice: Subject to any disclaimer, the term of this patent is extended or adjusted under 35 U.S.C. 154(b) by 133 days.

(21) Appl. No.: 14/184,847

(22) Filed: Feb. 20, 2014

(65) Prior Publication Data

US 2014/0255098 A1 Sep. 11, 2014

Related U.S. Application Data

(63) Continuation-in-part of application No. 14/109,382, filed on Dec. 17, 2013, and a continuation-in-part of application No. 14/162,430, filed on Jan. 23, 2014.

(60) Provisional application No. 61/772,873, filed on Mar. 5, 2013.

(51) Int. Cl.

| | |
|---|---|
| ***E02D 29/14*** | (2006.01) |
| ***E05C 3/12*** | (2006.01) |
| *E03F 5/06* | (2006.01) |

(52) U.S. Cl.

CPC ..... *E02D 29/1454* (2013.01); *E02D 29/14* (2013.01); *E03F 5/06* (2013.01); *E05C 3/12* (2013.01); *E03F 2005/068* (2013.01)

(58) Field of Classification Search

USPC ..... 405/36

See application file for complete search history.

(56) References Cited

U.S. PATENT DOCUMENTS

| | | | |
|---|---|---|---|
| 490,301 | A | 1/1893 | Munson |
| 838,601 | A | 12/1906 | Willms |

(Continued)

FOREIGN PATENT DOCUMENTS

| | | |
|---|---|---|
| CA | 1186871 | 5/1985 |
| CA | 1189294 | 6/1985 |

(Continued)

OTHER PUBLICATIONS

Gully Grating, Kerb Gratings, Products and Services, indiamart.com, searched Oct. 7, 2014, http://www.indiamart.com/jpkmetallics/kerb-gratings.html#gully-grating.

(Continued)

*Primary Examiner* — David Bagnell
*Assistant Examiner* — Kyle Armstrong
(74) *Attorney, Agent, or Firm* — Fasken Martineau DuMolin

(57) ABSTRACT

A frame for a cover for an inlet of one of a catch basin and a manhole is provided. The inlet has an inlet passageway having a first cross-sectional shape having an axis of symmetry. A hollow body of the frame defines a frame passageway and has a second cross-sectional shape having first and second sides opposite to one another. When the frame is installed, the hollow body has a lower end extending partially within at least one of the inlet passageway and a head portion reducing a surface area of the inlet passageway. The second cross-sectional shape is inscribed within the first cross-sectional shape, and a distance of the first side of the second cross-sectional shape to the axis of symmetry of the first cross-sectional shape is different from distance of the second side of the second cross-sectional shape to the axis of symmetry of the first cross-sectional shape.

7 Claims, 13 Drawing Sheets

(56) References Cited

U.S. PATENT DOCUMENTS

| | | | |
|---|---|---|---|
| 1,460,733 | A | 7/1923 | Rigby |
| 1,491,314 | A | 4/1924 | Rigby |
| 1,763,174 | A | 6/1930 | Morris |
| 1,858,268 | A | 5/1932 | Fleming |
| 2,701,027 | A | 2/1955 | Scoville |
| 3,304,685 | A | 2/1967 | Whetstone |
| 3,838,706 | A | 10/1974 | Klenk et al. |
| D244,854 | S | 6/1977 | Salamone |
| 4,126,404 | A | 11/1978 | Ferns |
| 4,279,541 | A | 7/1981 | Bruhn et al. |
| D267,268 | S | 12/1982 | Johnson |
| D270,292 | S | 8/1983 | Johnson |
| 4,422,994 | A | 12/1983 | Ditcher |
| D280,126 | S | 8/1985 | Provan et al. |
| 4,536,103 | A | 8/1985 | Prescott |
| 4,565,347 | A | 1/1986 | Ditcher |
| 4,591,290 | A | 5/1986 | Prescott |
| 4,685,650 | A | 8/1987 | Ditcher |
| 4,737,220 | A | 4/1988 | Ditcher et al. |
| 4,801,417 | A | 1/1989 | Ditcher |
| 4,941,643 | A | 7/1990 | Ditcher |
| 4,952,094 | A | 8/1990 | Spiess et al. |
| 5,072,846 | A | 12/1991 | Portwood |
| 5,095,667 | A | 3/1992 | Ryan et al. |
| D337,296 | S | 7/1993 | Steinke et al. |
| 5,279,007 | A | 1/1994 | Kolada |
| 5,299,884 | A | 4/1994 | Westhoff et al. |
| D352,573 | S | 11/1994 | Sampson et al. |
| 5,386,669 | A | 2/1995 | Almeida |
| D369,404 | S | 4/1996 | Vestal |
| 5,634,739 | A | 6/1997 | Armstrong |
| 5,849,181 | A | 12/1998 | Monteith |
| 6,045,691 | A | 4/2000 | McDermott |
| 6,068,765 | A | 5/2000 | Monteith |
| 6,109,824 | A | 8/2000 | Annès |
| 6,270,662 | B1 | 8/2001 | Gibson et al. |
| 6,385,913 | B1 | 5/2002 | Ahn |
| 6,537,446 | B1 | 3/2003 | Sanguinetti |
| 6,869,525 | B1 | 3/2005 | Happel |
| 6,986,226 | B2 | 1/2006 | Banks |
| 7,040,838 | B2 | 5/2006 | Allard et al. |
| D596,273 | S | 7/2009 | Porter |
| D630,714 | S | 1/2011 | Dukes |
| D658,440 | S | 5/2012 | Funnell, II et al. |
| 8,182,171 | B2 | 5/2012 | Poulsen |
| 8,292,541 | B2 | 10/2012 | Akkala |
| 8,591,729 | B2 | 11/2013 | Alqanee |
| D699,820 | S | 2/2014 | Beaudoin |
| D699,821 | S | 2/2014 | Beaudoin |
| D722,366 | S | 2/2015 | Beaudoin |
| D722,678 | S | 2/2015 | Beaudoin |
| D725,238 | S | 3/2015 | Beaudoin |
| 2002/0071722 | A1 | 6/2002 | Allard |
| 2003/0046877 | A1 | 3/2003 | Banks |
| 2004/0112811 | A1 | 6/2004 | Lindemulder |
| 2006/0011527 | A1 | 1/2006 | McDermott et al. |
| 2006/0230688 | A1 | 10/2006 | Carr |
| 2008/0179229 | A1 | 7/2008 | Dorsey |
| 2010/0124458 | A1 | 5/2010 | Munro |
| 2011/0150570 | A1* | 6/2011 | Pickavance ..... E02D 29/14 404/25 |
| 2013/0186811 | A1 | 7/2013 | Kaiser |

FOREIGN PATENT DOCUMENTS

| | | | |
|---|---|---|---|
| CA | 1204317 | | 5/1986 |
| CA | 1208025 | | 7/1986 |
| CA | 1245832 | | 12/1988 |
| CA | 1320071 | | 7/1993 |
| CA | 2153008 | A1 | 1/1996 |
| CA | 2220243 | A1 | 9/1997 |
| CA | 2206338 | A1 | 11/1998 |
| DE | 1002249 | | 2/1957 |
| DE | 6906871 | | 6/1969 |
| DE | 1905728 | | 8/1970 |
| DE | 4437518 | A1 | 4/1996 |
| DE | 29707603 | | 8/1997 |
| EP | 0337110 | A1 | 10/1989 |
| EP | 0668409 | A1 | 8/1995 |
| EP | 0694654 | A1 | 1/1996 |
| EP | 0811732 | A1 | 12/1997 |
| EP | 1254991 | A2 | 11/2002 |
| FR | 2200415 | | 4/1974 |
| FR | 2384904 | | 10/1978 |
| FR | 2740789 | A1 | 5/1997 |
| FR | 2803859 | A1 | 7/2001 |
| FR | 2920163 | A1 | 2/2009 |
| GB | 2205601 | | 12/1988 |
| WO | 96/01929 | A1 | 1/1996 |
| WO | 97/26415 | A1 | 7/1997 |
| WO | 97/49872 | A1 | 12/1997 |
| WO | 01/83892 | A1 | 11/2001 |

OTHER PUBLICATIONS

Industries Fortier Ltée, "Catch Basin", datasheet, 1 page, publicly available at least as of Dec. 17, 2012, Canada.

Groupe Lecuyer, "Catch basin for rectangular cast iron grate of 455mm×915mm", datasheet, 1 page, available on the internet at http://www.lecuyerbeton.com/en/products/storm-and-sanitary-products/catch-basins-and-manholes-catch-basins/regards-puisards at least as of Jan. 9, 2009, Canada.

Béton Provincial, "Reinforced concrete catch basins", datasheet, 1 page, available on the internet at http://www.betonprovincial.com/public/files/pdf/en/manuel-techniques/REINFORCED-CONCRETE-CATCH-BASINS.pdf at least as of Apr. 7, 2009, Canada.

* cited by examiner

ECCENTRIC FRAME FOR AN INLET OF A CATCH BASIN OR MANHOLE

TECHNICAL FIELD

The invention relates to a frame for an inlet of a catch basin or a manhole.

BACKGROUND OF THE ART

During road construction, storm drains (also known as catch basins) and sewer inlets are disposed at various points along the road to evacuate excess water and/or debris that may accumulate. Such accumulation can occur for example during rainfall.

The storm drains (or catch basins) are connected to a system which is a network of pipes, pumps, and force mains for the collection of wastewater, or sewage, from the community. Typically, storm drains use a separate and distinct network from sanitary sewer systems for human waste. Sometimes a combined system provides only one network for all types of sewage and excess water or debris.

In order to evacuate the excess water and debris toward the system, the storm drain includes an inlet disposed on the road surface. Two main types of inlets exist: the side inlet and the grated inlet. The typically ends in an outlet for the water which is a single large exit at the point of discharge. The separation of storm sewers from sanitary sewers helps to prevent sewage treatment plants becoming overwhelmed by infiltration/inflow during a rainstorm, which can result in untreated sewage being discharged into the environment.

The grated inlets prevent pedestrians, vehicles and large objects from falling into the storm drain. The design of the grate bars facilitates a flow of water towards the inside of the drain. Storm drains provided in streets and parking areas must be strong enough to support the weight of the vehicles. The grate is usually relatively small to avoid reducing the structural integrity of the road on which vehicles travel. Some of the heavier sediment and small objects or debris may enter the grated inlet and settle in the catch basin below the inlet. A frame is provided for the catch basin or catch pit and the grate covers the open top of the frame of the catch basin. The frame supports the grate/cover.

To optimize the flow of water, the grate is often positioned close to the curb and the surface of the road is slightly angled away from the middle of the road to allow water to flow towards the grate and into the catch basin.

Some frames include a lower flange which is adapted to rest on top of the inlet of the catch basin, such that the vertical passageway may be positioned adjacent to the curb with part of the passageway being vertically above the inlet and part of the passageway being vertically above a portion of the rim of the inlet.

Unfortunately, this configuration creates an elbow which reduces the water flow efficiency of the catch basin. Furthermore, the lower flange may not fit adequately on the rim of the inlet and a portion of the flange may overhang above the inlet of the catch basin instead of being fully supported by the rim of the inlet. This configuration may therefore not be adapted to properly support the loads created by vehicles travelling near the curb.

SUMMARY

In accordance with one aspect, there is provided a frame for a cover for an inlet of one of a catch basin and a manhole. The inlet has an inlet passageway having a first cross-sectional shape. The first cross-sectional shape has an axis of symmetry. The frame comprises a hollow body defining a frame passageway therethrough. The hollow body has a second cross-sectional shape. The second cross-sectional shape has a first side and a second side opposite to the first side. When the frame is installed onto the one of the catch basin and the manhole, the inlet passageway is in communication with the frame passageway. The hollow body has a lower end extending partially within at least one of the inlet passageway and a head portion reducing a surface area of the inlet passageway. As seen from a top, the second cross-sectional shape is inscribed within the first cross-sectional shape, a distance of the first side of the second cross-sectional shape to the axis of symmetry of the first cross-sectional shape is different from distance of the second side of the second cross-sectional shape to the axis of symmetry of the first cross-sectional shape.

In one embodiment, the first and second sides of the second cross-sectional shape are straights.

In one embodiment, the second cross-sectional shape includes third and fourth sides disposed between the first and second sides and opposite to each other.

In one embodiment, the third and fourth sides are curved.

In one embodiment, the first and second sides are parallel to the axis of symmetry.

In one embodiment, the axis of symmetry is disposed between the first and second sides.

In one embodiment, the first cross-sectional shape is a circle.

In one embodiment, the second cross-sectional shape is a truncated circle.

In one embodiment, the axis of symmetry is a first axis of symmetry. The first cross-sectional shape includes a second axis of symmetry. The second cross-sectional shape is symmetric with respect to second axis of symmetry.

Embodiments of the present can have at least one of the above-mentioned aspects, but do not necessarily have all of them.

Additional and/or alternative features, aspects, and advantages of embodiments of the present will become apparent from the following description, the accompanying drawings, and the appended claims.

BRIEF DESCRIPTION OF THE DRAWINGS

Having thus generally described the nature of the invention, reference will now be made to the accompanying drawings, showing by way of illustration embodiments, aspects and features thereof and in which:

FIG. 1 includes FIG. 1A and FIG. 1B in which

FIG. 2 includes FIG. 2A, FIG. 2B and FIG. 2C in which

FIG. 7 includes FIG. 7A, FIG. 7B, FIG. 7C and FIG. 7D in which

It will be noted that throughout the appended drawings, like features are identified by like reference numerals.

DETAILED DESCRIPTION

Figure 1A:
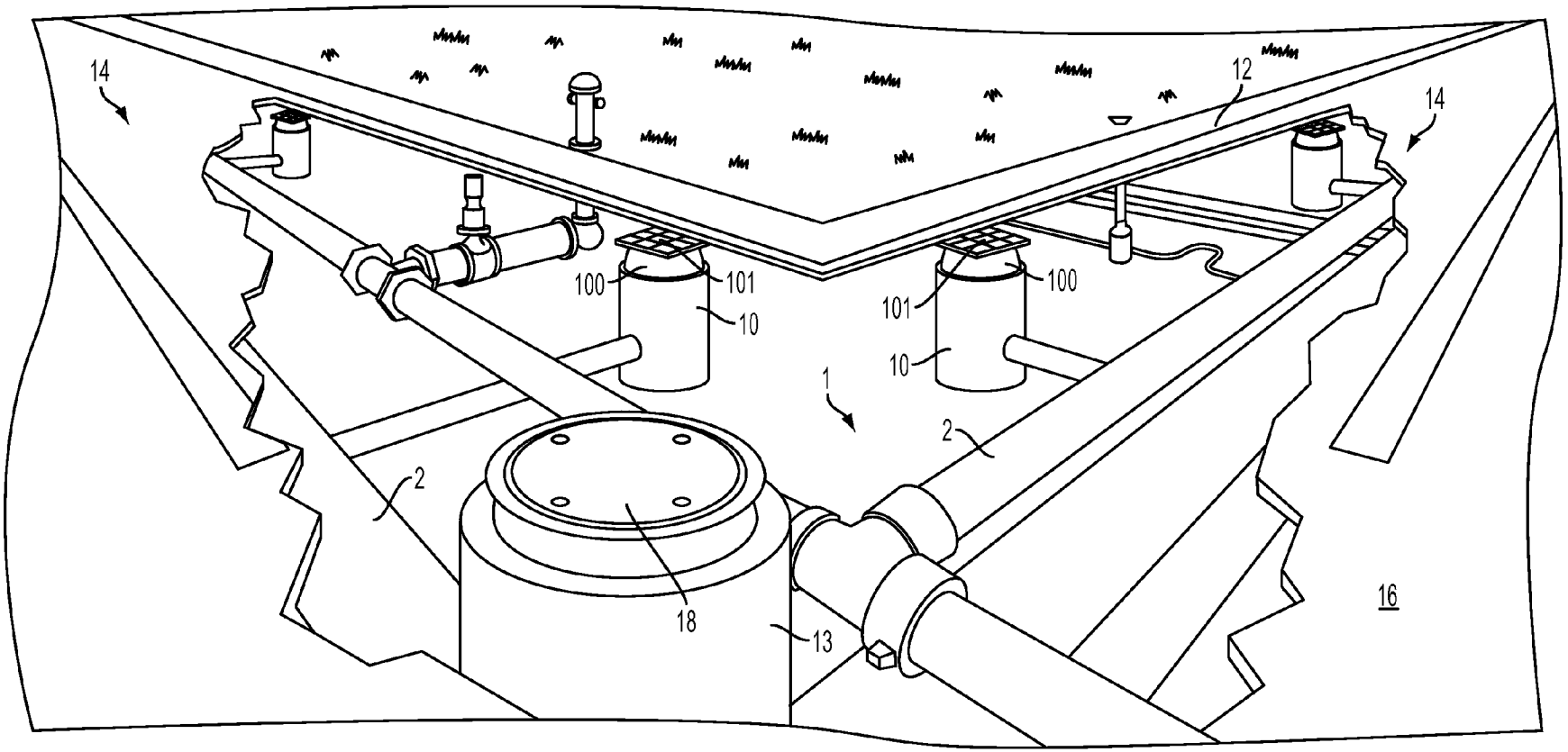
FIG. 1A shows a sewerage system under a road and FIG. 1B shows a close-up of a catch basin and a frame supporting a grate.
Figure 1B:
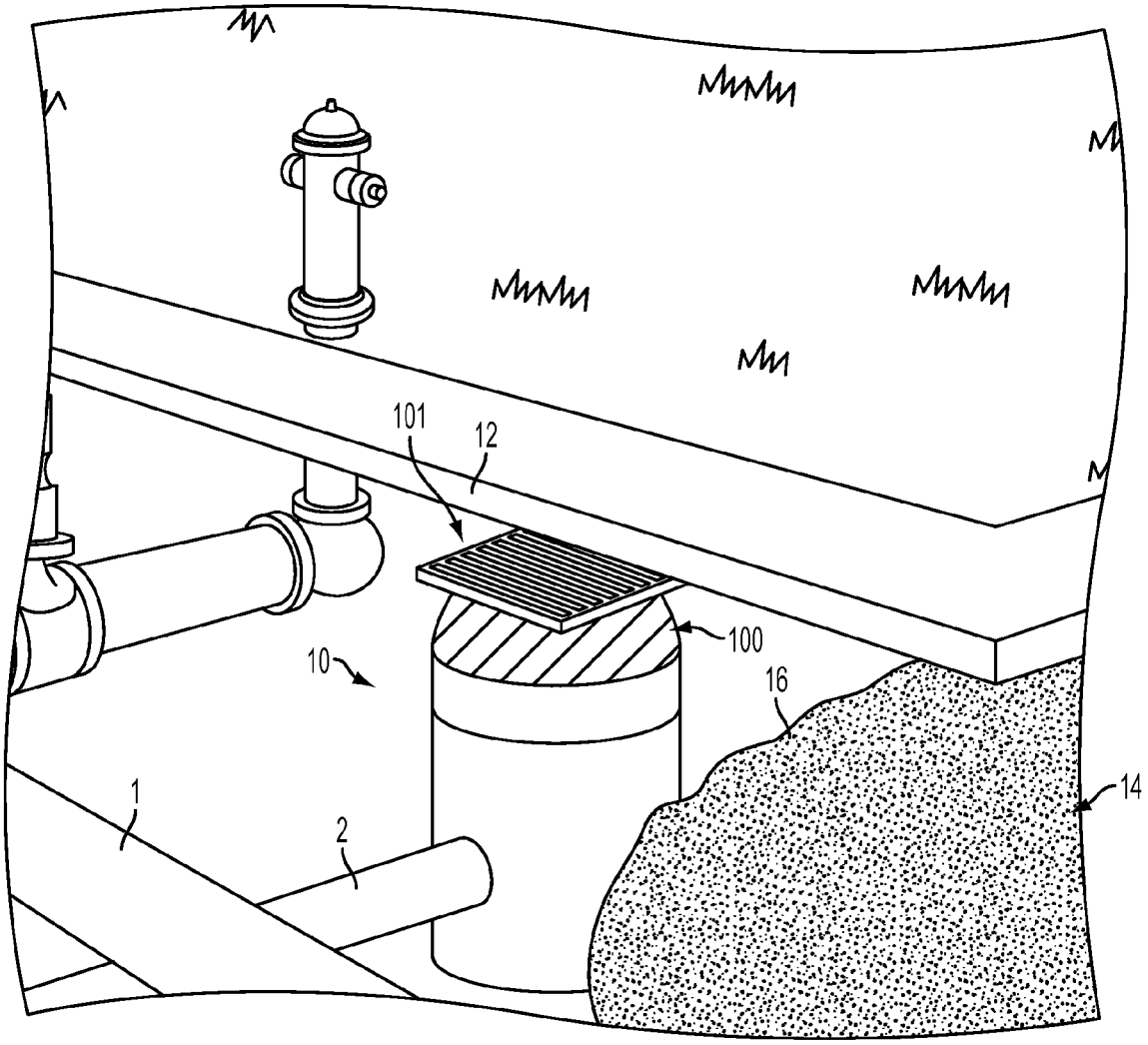

Referring to FIG. 1, a sewerage system 1 includes a plurality of interconnected pipes or conduits 2, disposed underground below a concrete or paved road 14. A plurality of manholes and catch basins 10 connect the sewerage system 1 to an upper surface 16 of the road 14. As illustrated in FIG. 1, the catch basins 10 are located on lateral sides of the road 14 near sidewalks or curbs 12, while the plurality of manholes 13 are found toward a middle of the road 14. The manholes 13 have closed covers 18 which do not allow the passage of debris, while the catch basins 10 have open grated covers 101 which allow passage of excess water and small debris. A frame 100 connects the grate 101 to its associated catch basin 10. While the below description refers to the frame 100 disposed onto the catch basin 10 having the grate 101, it is contemplated that the frame 100 could be disposed onto a manhole 13 having a cover 18. It is contemplated that one, some or all of the plurality of manholes 13 could be provided with grated covers 101 instead of closed covers 18. The frame 100 will be described in detail below.

Figure 2A:
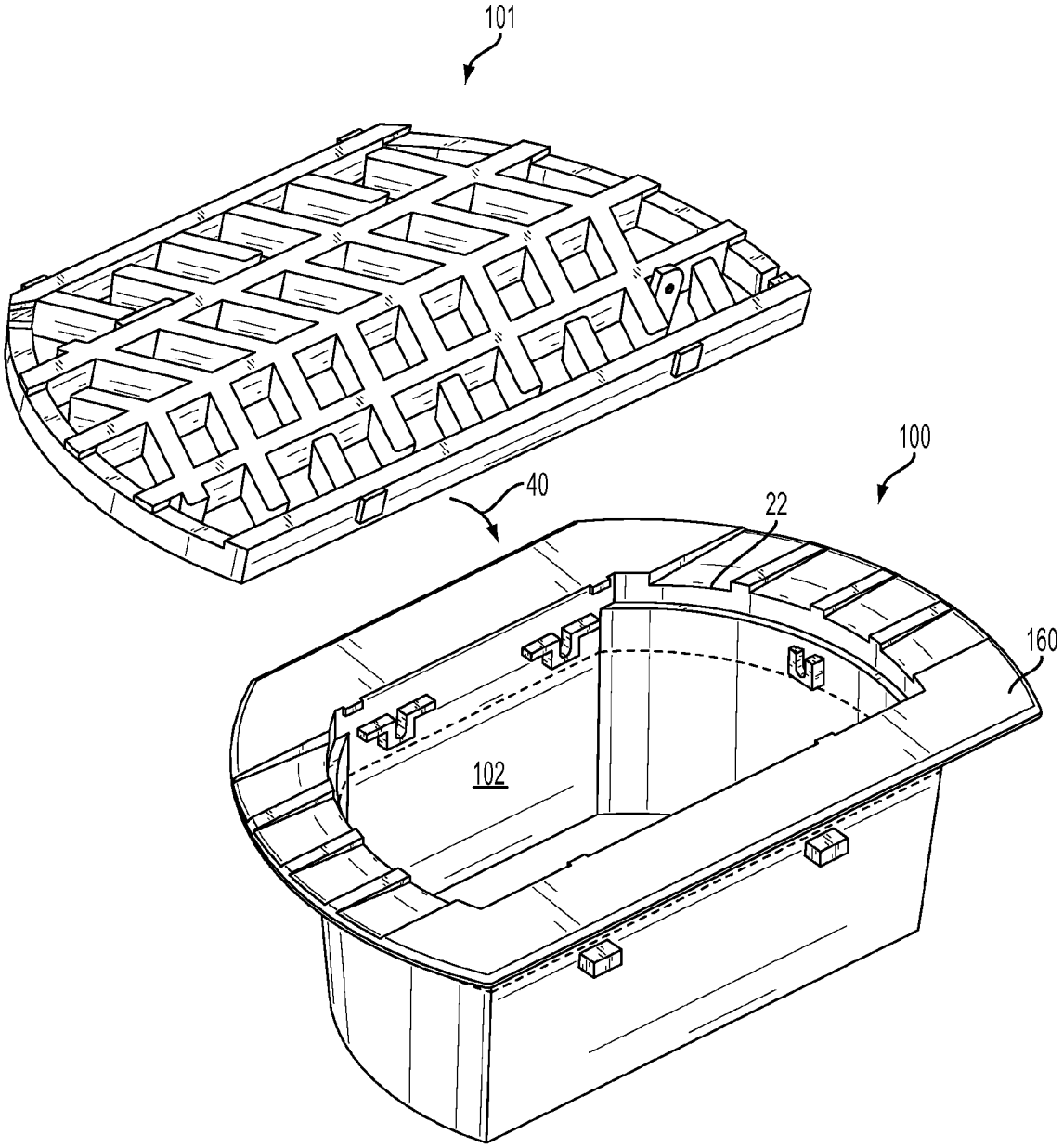
FIG. 2A is a perspective view of an example frame and grate and FIG. 2B is a perspective view of the frame and grate of FIG. 2A assembled and provided at the inlet of a catch basin, shown in transparency
Figure 2B:
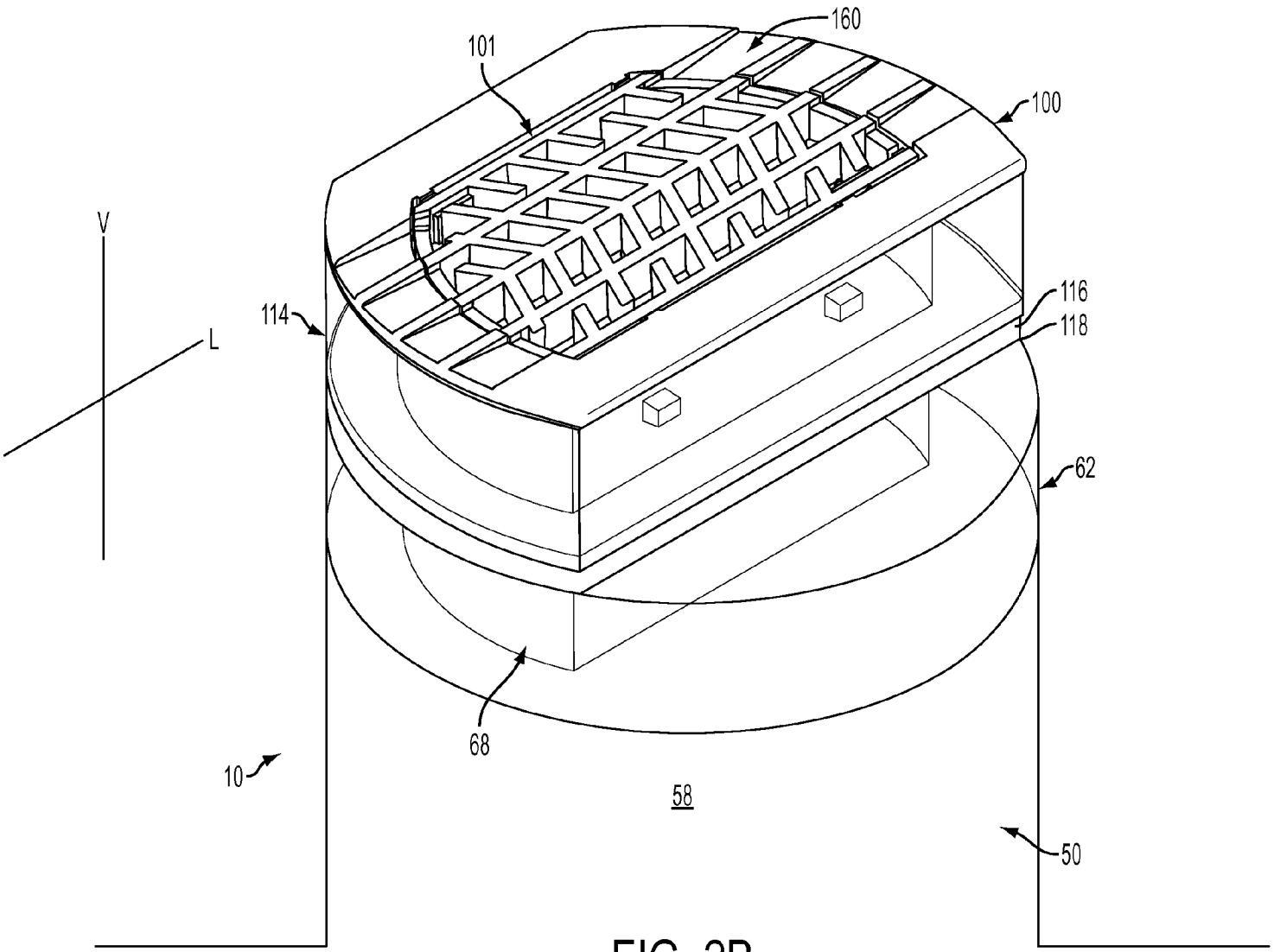
Figure 2C:
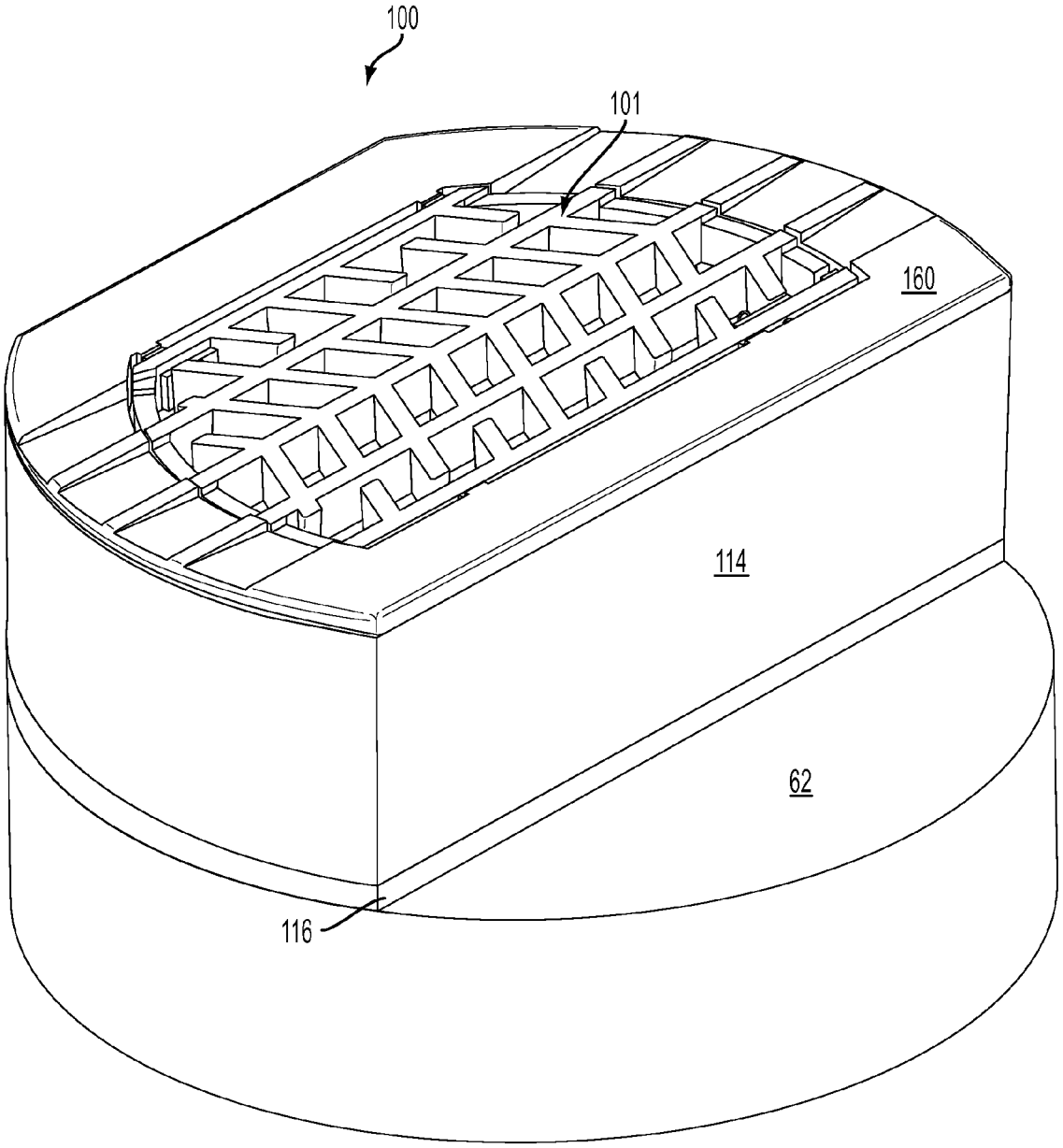
FIG. 2C is an exterior view of a frame, grate and catch basin inlet.

Referring to FIG. 2, an assembly of the grate 101 with the frame 100 will be described. The frame has an open top defined by a grate receiving contour 22. The grate receiving contour 22 has a shape mating the outer shape of the grate 101. The frame 100 includes walls extending downwardly from the grate receiving contour 22. The walls are to be inserted into the catch pit. Side flanges 160 extend laterally from the grate receiving contour 22. The side flange(s) 160 help prevent water infiltration between the frame 100 and the concrete or asphalt pavement. The grooves help water enter the catch basin by gravity. FIG. 2C shows the frame 100 inserted in the concrete sleeve 114 and further provided on concrete head 62 with a shim 116. Grate 101 is shown installed on frame 100.

Figure 3:
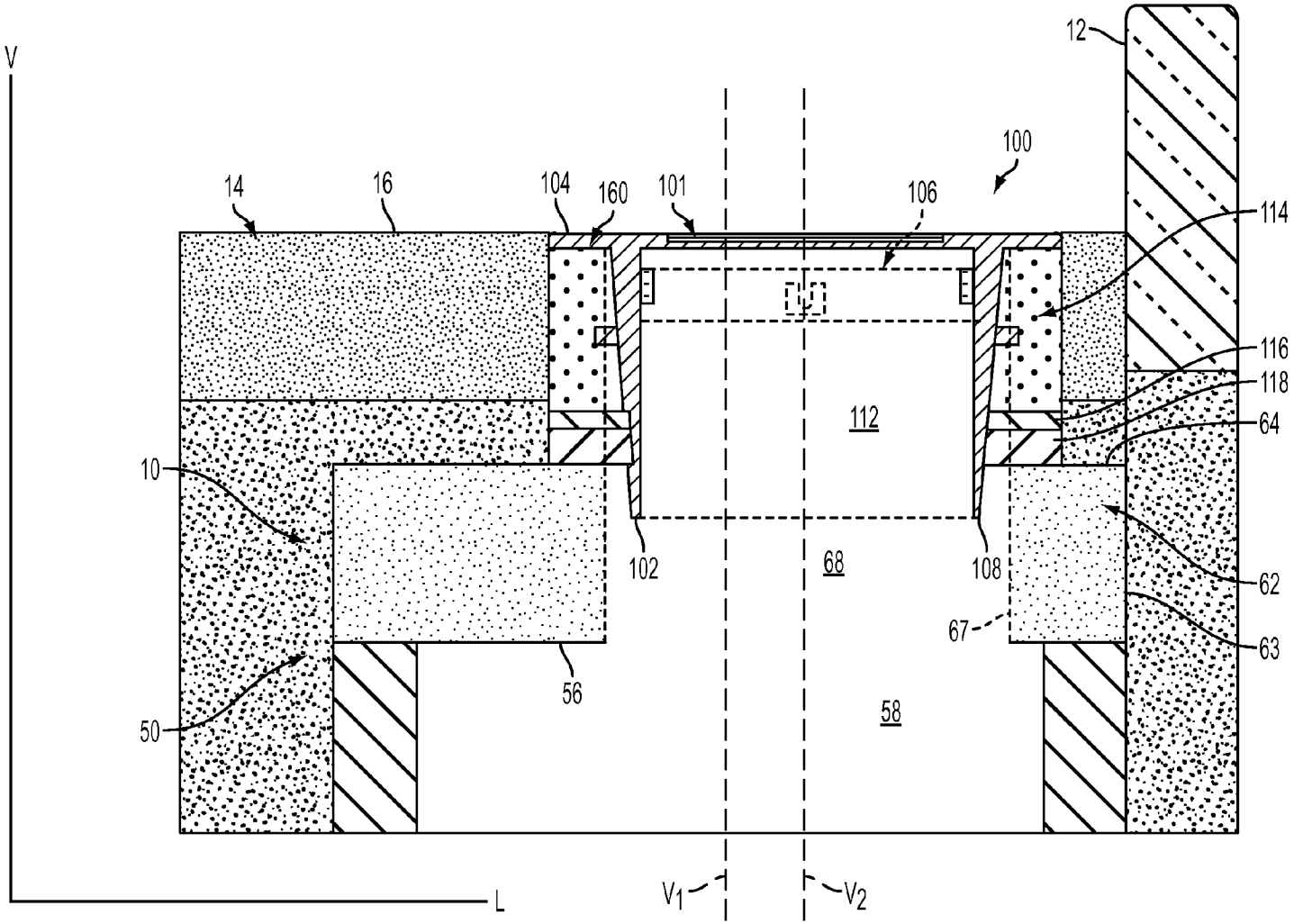
FIG. 3 is a cross-sectional view of the assembled frame, grate and catch basin inlet of FIG. 2.

Referring to FIG. 3, the cross-sectional dimensions and orientations of the assembly of the catch basin 10 with the frame 100 will be described. The description will refer to the following orientations: vertical will be along a vertical direction V, and horizontal/lateral/radial will be along a lateral direction L.

The catch basin 10 has an inlet 50 located near the top surface 16 of the road 14. The inlet 50 defines a passageway 58. The passageway 58 has a vertical central axis $V_1$. The passageway 58 is circular in cross-section and symmetric about the vertical central axis $V_1$. It is contemplated that the passageway 58 could be asymmetric about the vertical central axis $V_1$, but that the vertical central axis $V_1$ would still be centrally located relative to the passageway 58. Additionally or alternatively, the frame 100 may be asymmetrical or eccentric to provide the grate/cover 101 closer to the curb.

A head portion 62, made of concrete and casted before installation, is fixedly connected to an upper end 56 of the inlet 50. The head portion 62 has a passageway 68 extending therethrough. The passageway 68 is in communication with the passageway 58. The passageway 68 has a cross-section of a smaller surface area than that of the passageway 58. As such, the head portion 62 allows reducing a surface area of the passageway 58 of the inlet 50 of the catch basin 10 to a surface area that would allow the frame 100 to rest onto the head portion 62. An outer wall 63 of the head portion 62 has a cross-sectional shape of the passageway 58 (for example, circular), while an inner wall 67 (and as a consequence passageway 68) of the head portion 62 has a cross-sectional shape of the hollow body 102 of the frame 100 (for example, truncated circle). It is contemplated that the cross-sectional shapes of the passageways 58, 68 could be different than shown herein, should for example, the inlet 50 not be circular or the frame 100 not have a truncated circular cross-section.

The passageway 68 has a vertical central axis $V_2$ that is offset towards the curb 12 relative to the vertical central axis $V_1$ of the passageway 58. This allows the frame 100 to be positioned relatively close to the curb 12 so as to increase efficiency of the flow of water. Although the head portion 62 is shown herein to be distinct from the inlet 50, it is contemplated that the head portion 62 could be integrally formed with the inlet 50.

The frame 100 has a hollow body 102 defining a passageway 112 therethrough. The passageway 112 is in communication with the passageways 58 and 68, such that the passageways 58, 68, 112 are vertically aligned with each other. As such, no elbow is created between the passageways 58, 68, 112. The hollow body 102 is surrounded by a concrete sleeve 114 casted thereonto. It is contemplated that the concrete sleeve 114 could be omitted. When the frame 100 is assembled onto the catch basin 10, the concrete sleeve 114 sits on top of the head portion 62. The concrete sleeve 114 provides additional structural strength to the frame 100, and a lower end 108 of the hollow body 102 extends into the passageway 68 of the head portion 62. It is contemplated that the frame 100 could extend further below partially into the passageway 58 of the inlet 50.

Shims 116, 118 are disposed vertically between the concrete sleeve 114 and the head 62. It is contemplated that the shims 116, 118 could be omitted. It is also contemplated that only one or more than two shims 116, 118 could be used. Although the frame 100 is shown in the Figures to be vertically disposed above the inlet 50, it is contemplated that the frame 100 could be angled relative to the upper end 64 of the head portion 62. For example, should the top surface 16 of the road 14 be angled relative to the upper end 64 of the head portion 62, the frame 100 would also be angled relative to the upper end 64 to provide the grate 101 in alignment with the angled top surface 16 of the road 14. In one embodiment, the shims 116, 118 are sized and shaped to allow the frame 100 to be disposed at such an angle.

Figure 4:
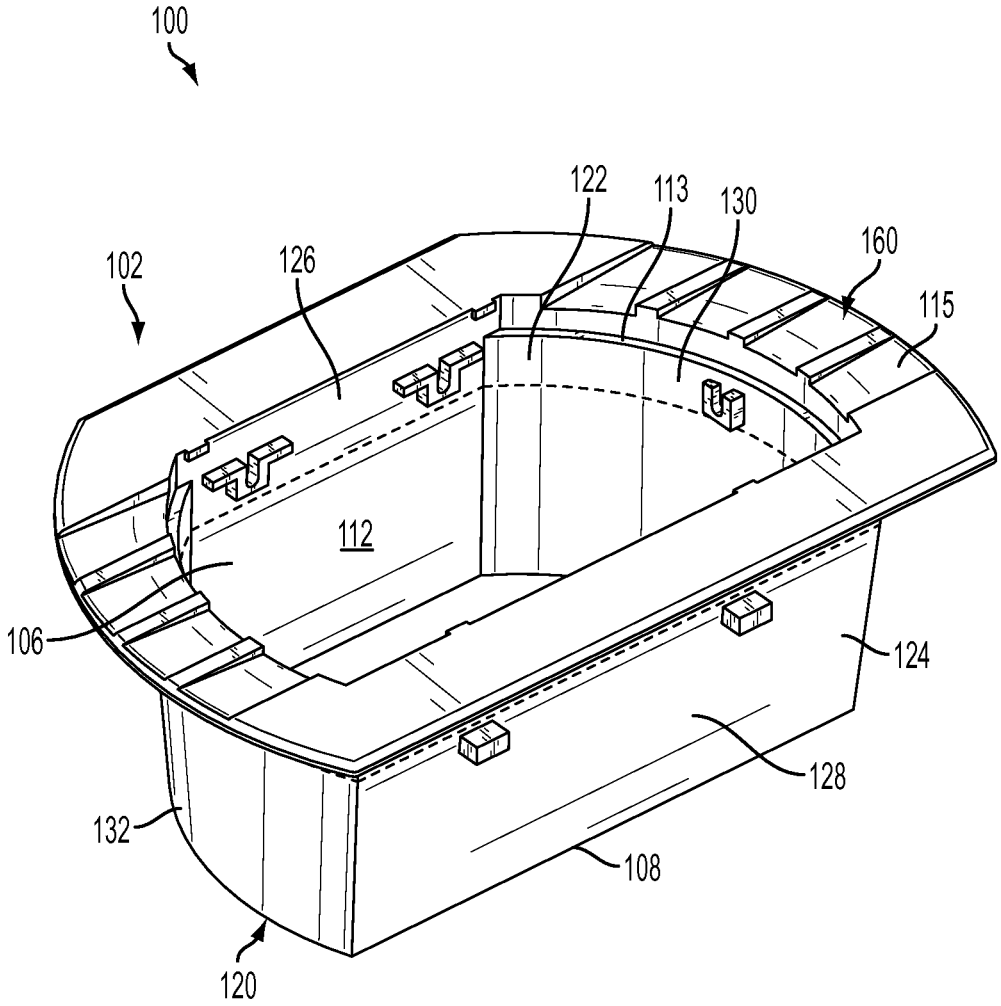
FIG. 4 is a perspective view of a frame with a full flange.

Turning to FIG. 4, the frame 100 will now be described. The frame 100 is made of ductile iron. It is contemplated that the hollow body 102 could be made of cast iron, or a polymer, or hard rubber, or any suitable material (low deformation and resistant to wear and weather). The hollow body 102 has an upper end 104 which defines an inlet of the passageway 112, and a lower end 108 which defines an outlet of the passageway 112. The passageway 112 is defined by a sidewall 120 which includes first wall portion 126, a second wall portion 128 opposite the first wall portion 126, a third wall portion 130 adjacent the first and second wall portions 126, 128 and a fourth wall portion 132 opposite the third wall portion 130. The hollow body 102 has an asymmetrical or eccentric cross-section. More particularly, it has an asymmetrical truncated circular cross-section. According to this configuration, the first and second wall portions 126, 128 are straight and the third and fourth wall portions 130, 132 are outwardly convex relative to the passageway 112 of the frame 100. Furthermore, the first wall portion 126 is shorter than the second wall portion 128. The sidewall 120 has thus a cross-section in a shape of a truncated circle as discussed above. It is contemplated that the passageway 112 could have a cross-section other than the ones shown in the Figures. For example, the passageway 112 could have a circular cross-section or a rectangular cross-section or any other shape desired.

The sidewall 120 has an inner surface 122 and an outer surface 124. The inner surface 122 is generally vertically straight having a small angle with respect to the vertical V to allow its removal from a mold during its making. It is contemplated that the inner surface 122 of the hollow body 102 may have a different angle than shown in the Figures or not be straight and have for example have a variety of highs and dips. As best shown in FIG. 2, the outer surface 124 is tapered inwardly from the upper end 104 of the hollow body 102 to the lower end 108 of the hollow body 102. It is contemplated that the outer surface 124 could be straight or have a taper angle higher or lower than shown in the Figures.

The upper end 104 of the hollow body 102 includes a flange 160 which extends outwardly relative to the frame inlet 106 in the lateral direction L. A top surface of the concrete sleeve 114 abuts and is totally covered by an under surface of the laterally extending flange 160, so as to reduce water infiltration and reduce wear of the concrete sleeve 114. It is contemplated that the concrete sleeve 114 could be shorter than the flange 160. It is contemplated that the flange 160 could extend only partially around the frame inlet 106. It is also contemplated that the hollow body 102 could have more than one flange.

The flange 160 includes a plurality of discharge grooves 115. The discharge grooves 115 are slightly slanted with respect to the horizontal toward the passageway 112 so as to facilitate water to flow from the road 14 toward the inlet 50 of the catch basin 10. It is contemplated that the discharge grooves 115 could be different from shown in the Figures. For example, the laterally extending flange 160 could have only one discharge groove. In another example, the discharge groove is larger than the ones shown in the Figures. It is also contemplated that the lateral extending flange 160 could not have any discharge groove.

The upper end 104 includes a recess 113 which forms a step adapted to receive a grate 101. Once the grate 101 is placed onto the recess 113, the grate 101 is in alignment with the top surface 16 of the road 14.

Figure 5:
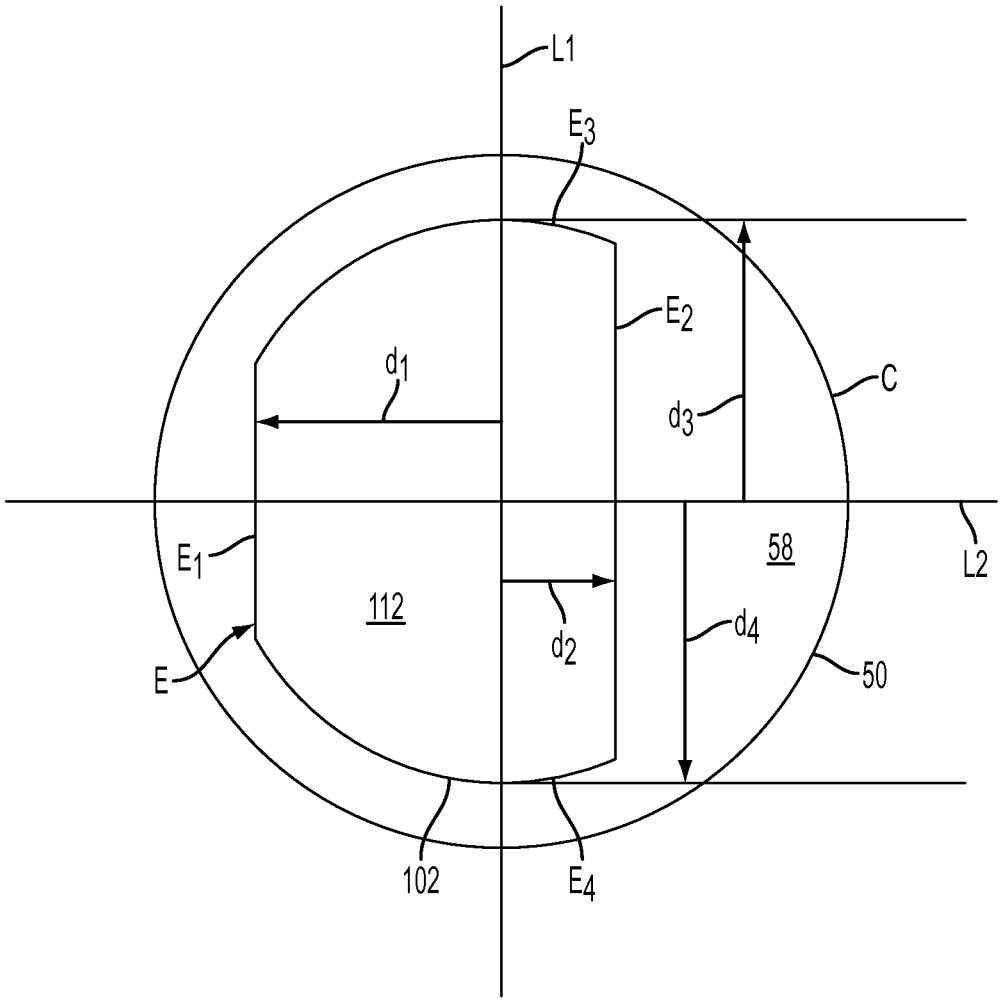
FIG. 5 is a schematic of outlines of a passageway of a frame and a passageway of an inlet of the catch basin.

Turning to FIG. 5, an outline C of the passageway 58 of the inlet 50 and an outline E of the passageway 112 of the hollow body 102 of the frame 100 are shown as seen from a top, when the frame 100 is installed onto the catch basin 10.

The outline E is inscribed within the outline C. In other words, when installed and seen from a top, the outline E of the passageway 112 of the frame 100 is contained within the outline C of the inlet 50 of the catch basin 10. As such, the passageway 112 of the frame 100 is off-centered relative to the inlet 50 yet in vertical alignment with the passageway 58. No elbow is created and the water flow directly from the grate 101 into the inlet 50, thereby optimizing efficiency of the flow of water towards the catch basin 10.

The outline E is off centered (or eccentrically located) relative to the outline C. The outline C being circular, axes of symmetry L1 and L2 can be defined. L1 and L2 are perpendicular to each other and an intersection between L1 and L2 defines a center of the passageway 58. The outline E has a first outline portion E1 corresponding to the first wall portion 126, a second outline portion E2 corresponding to the second wall portion 128, a third outline portion E3 corresponding to the third wall portion 130, and a fourth outline portion E4 corresponding to the fourth wall portion 132. The first and second outline portions E1, E2 are parallel to the axis L1. The first outline portion E1 is at a distance d1 from the axis L2, and the second outline portion E2 is disposed at a distance d2 of the axis L1. The distance d2 is shorter than the distance d1 and the axis L1 is disposed between the first and second outline portions E1, E2. This means that the outline E is not symmetric about the axis of symmetry L1 of the outline C. As such, the frame 100 is off centered (or eccentric) relative to the passageway 58 of the inlet 50 of the catch basin 10. Because the frame 100 has its passageway 112 eccentrically located from the inlet 50, the grate 101 is located closer to the curb 12 than it would, should the frame 100 have a common central axis with the inlet 50.

The third outline portion E3 is at a distance d3 from the axis L2, and the fourth outline portion E4 is disposed at a distance d4 of the axis L2. The distance d3 is equal to the distance d4 and the axis L2 is disposed between the third and fourth outline portions E3, E4. It is contemplated that the distance d3 could be different from the distance d4. The outline E is symmetric about the axis of symmetry L2 of the outline C. It is contemplated that the outline E could not be symmetric about the axis of symmetry L2.

Figure 6:
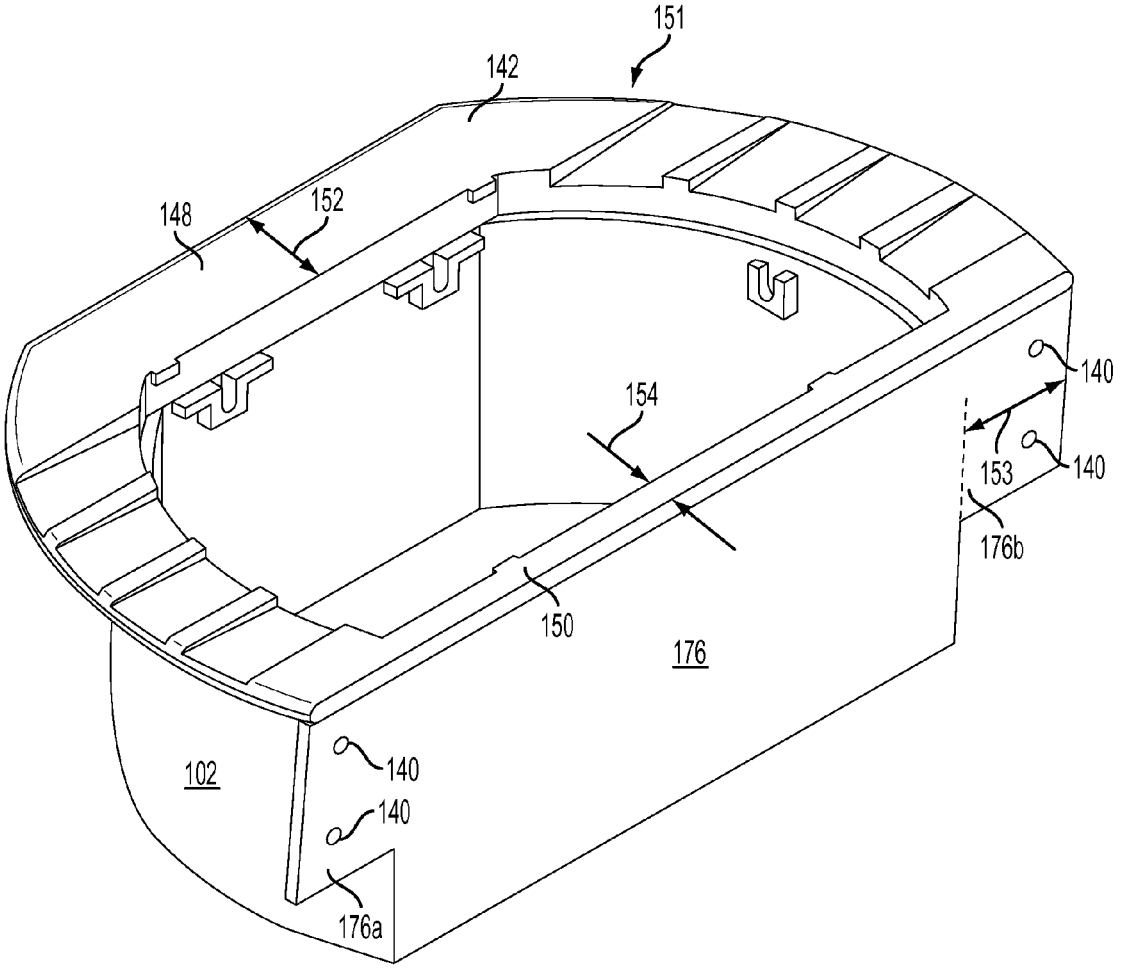
FIG. 6 is a perspective view of a frame with a 3-sided flange.

FIG. 6 shows an alternative embodiment in which wall 176 has extensions **176*a* and 176*b*. Width 153 of extensions 176*a*, 176*b* ensures that the extensions are covered by alternative flange 148 while extending beyond the surface of the hollow body 102. Openings 140 provided on extensions 176*a* and 176*b* are used to assemble the alternative frame skeleton 142** to a concrete sleeve.

Alternative frame skeleton 142 has an alternatively shaped flange 148. Alternative flange 148 is three-sided since the flange section 150 does not extend radially outward from wall 176. Width 152 of the wider section of the alternative flange 148 is greater than width 154 of flange section 150. In one embodiment, width 152 can correspond to the thickness of wall 176. This embodiment facilitates installation of the grate/cover closer to the curb, sidewalk or side of the road.

When using the alternative embodiment of FIG. 6, an independently prepared concrete sleeve is typically used and attached to the frame skeleton 142 using attachment means such as screws and bolts and openings 140. Other attachment means could be used rods, wires, bars, etc. Once assembled, the alternative frame 151 is ready to be used. Alternatively, the concrete sleeve could be casted around the frame skeleton using an appropriately shaped mold.

FIG. 7 shows an alternative installation embodiment in which a guide or holder 170 is used. The guide or holder has a shape adapted to receive the hollow body 102 of frame 100 in its opening 172 as shown in FIG. 7B. It is positioned on the head portion 62 and helps to secure the frame onto the head portion. After installation, concrete is poured to create a solidary unit.

Figure 7A:
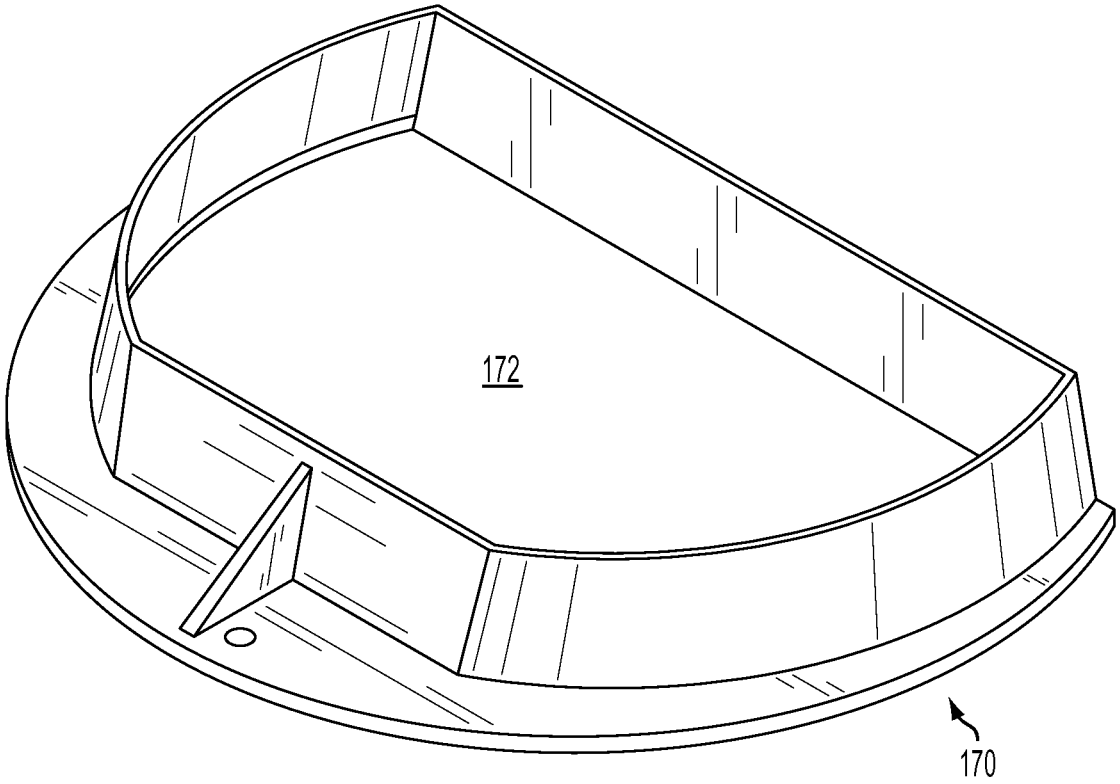
FIG. 7A shows a guide for the installation of a frame.
Figure 7B:
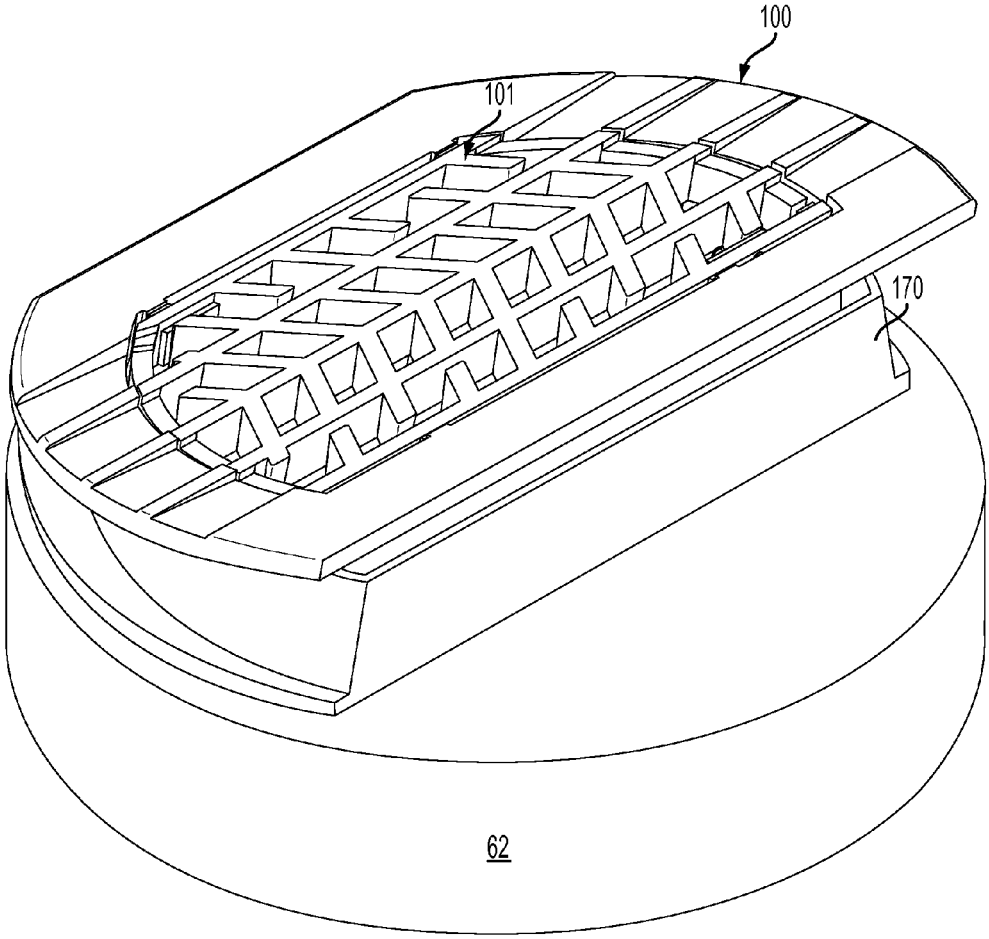
FIG. 7B shows a frame provided in a guide and in the inlet of a catch basin.
Figure 7C:
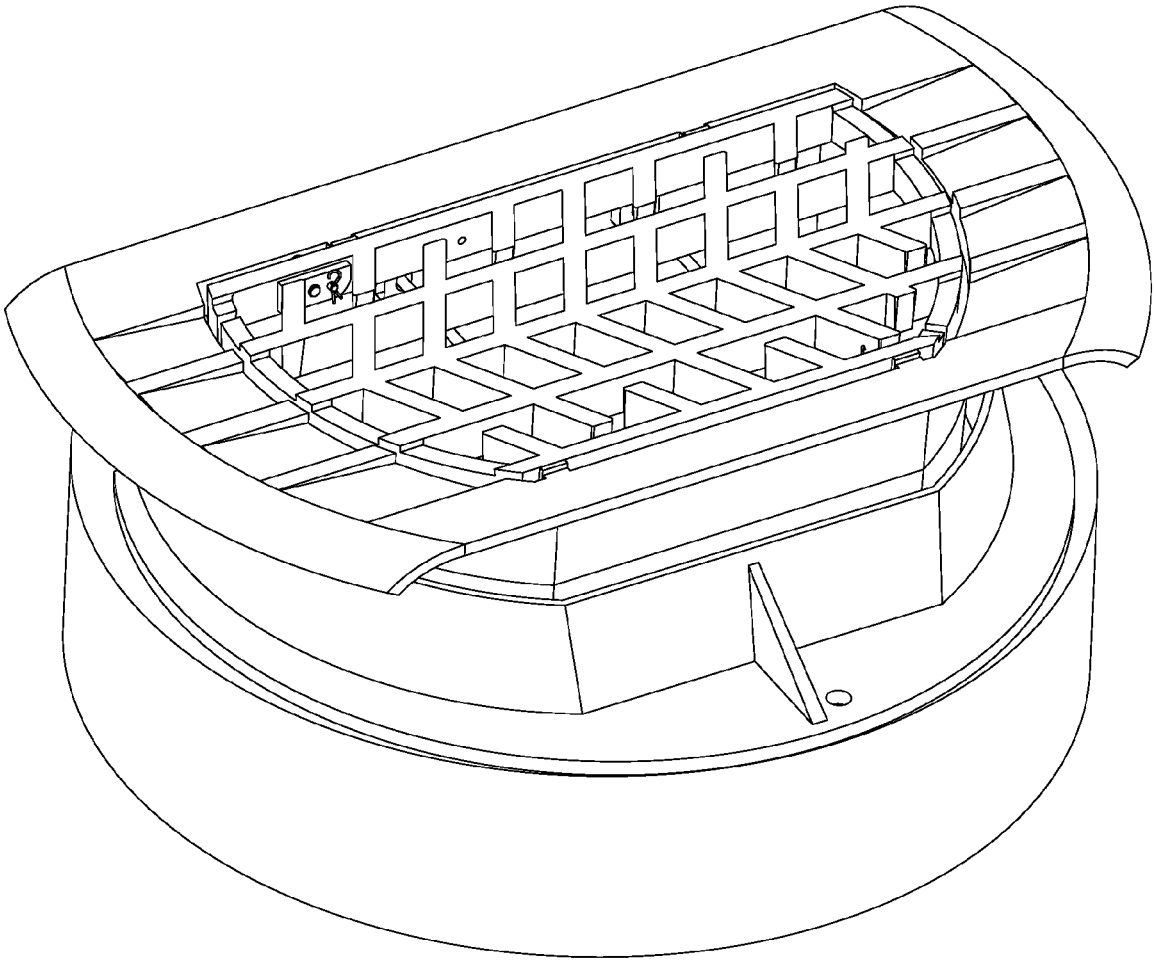
FIG. 7C shows a frame with an anti-lifting curved panel provided in a guide and in the inlet of a catch basin and FIG. 7D shows the frame of FIG. 7C.
Figure 7D:
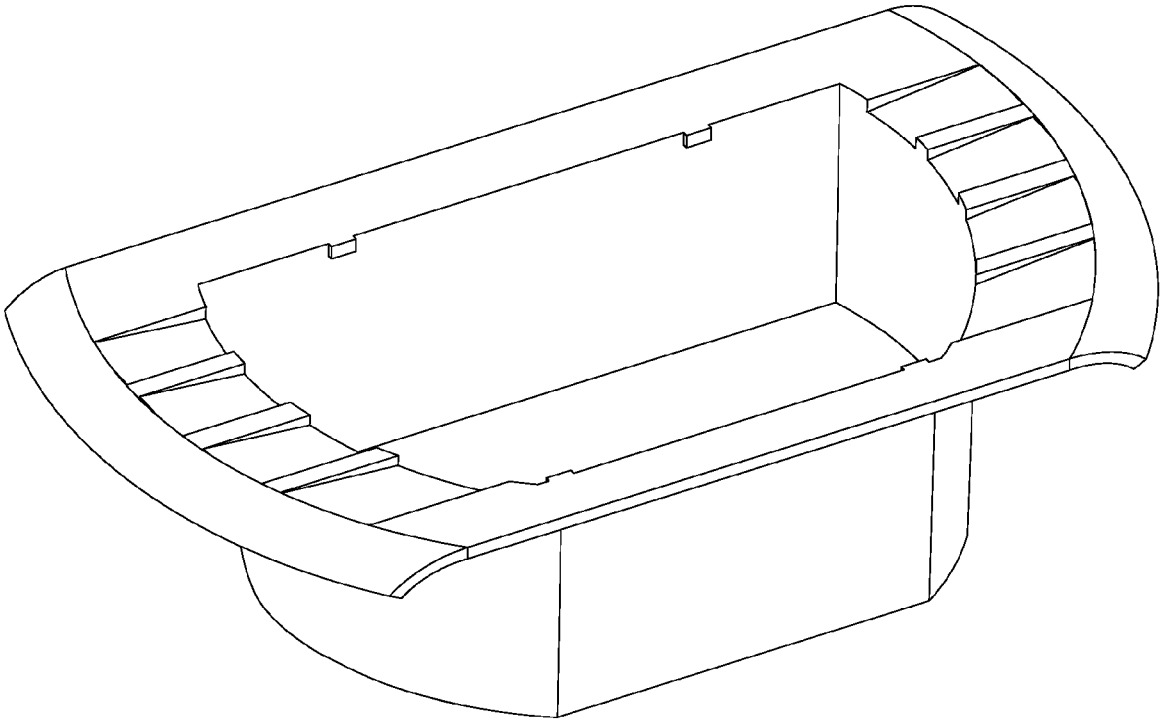

FIG. 7C shows a frame with an optional anti-lifting curved panel. The anti-lifting curved panel curves toward the head portion of the sewerage system. The optional anti-lifting curved panel is provided on the exterior of the flange with the water grooves. The anti-lifting curved panel reduces a chance of snow removal machinery and other maintenance vehicles and devices from hitting the edge of the flange and lifting the frame and/or grate by mistake. It is typically used only when the sewer grate/frame is installed on asphalt roads and not when the sewer grate/frame is installed on concrete roads but it is contemplated that it could be used on both types of installation or not at all. FIG. 7D shows the frame of FIG. 7C taken out of the guide and head portion.

The embodiments described above are intended to be exemplary only. The scope of the invention is therefore intended to be limited solely by the appended claims.

I claim:

1. A frame for a cover for one of a catch basin and a manhole, the one of a catch basin and the manhole having an inlet, the inlet having an inlet passageway having a first cross-sectional shape, the first cross-sectional shape having an axis of symmetry, the frame comprising:

a hollow body defining a frame passageway therethrough, the hollow body having a second cross-sectional shape, the second cross-sectional shape having a first side and a second side opposite to the first side and the sides are straight and of unequal length, when the frame is installed onto the one of the catch basin and the manhole, the inlet passageway is in communication with the frame passageway, the hollow body has a lower end extending partially within at least one of the inlet passageway and a head portion reducing a surface area of the inlet passageway, as seen from a top, the second cross-sectional shape is inscribed within the first cross-sectional shape, a distance of the first side of the second cross-sectional shape to the axis of symmetry of the first cross-sectional shape is different from distance of the second side of the second cross-sectional shape to the axis of symmetry of the first cross-sectional shape, and wherein the second cross-sectional shape is a truncated circle.

2. The frame of claim 1, wherein the second cross-sectional shape includes third and fourth sides disposed between the first and second sides and opposite to each other.

3. The frame of claim 2, wherein the third and fourth sides are curved.

4. The frame of claim 1, wherein the first and second sides are parallel to the axis of symmetry.

5. The frame of claim 1, wherein the axis of symmetry is disposed between the first and second sides.

6. The frame of claim 1, wherein the first cross-sectional shape is a circle.

7. The frame of claim 1, wherein the axis of symmetry is a first axis of symmetry;

the first cross-sectional shape includes a second axis of symmetry; and the second cross-sectional shape is symmetric with respect to second axis of symmetry.

* * * * *